US005328630A

United States Patent [19]

Nozaki et al.

[11] Patent Number: 5,328,630

[45] Date of Patent: Jul. 12, 1994

[54] LIQUID DETERGENT COMPOSITION BASED ON N-ACYLAMINO ACID POTASSIUM SALT

[75] Inventors: Toshio Nozaki, Chiba; Masayo Kawaguchi, Wakayama; Hiroshi Watanabe, Chiba, all of Japan

[73] Assignee: Kao Corporation, Tokyo, Japan

[21] Appl. No.: 985,197

[22] Filed: Dec. 3, 1992

[30] Foreign Application Priority Data

Dec. 4, 1991 [JP] Japan ..... 3-320690

[51] Int. Cl.[5] ..... C11D 1/37; C11D 1/10; C11D 3/33

[52] U.S. Cl. ..... 252/117; 252/173; 252/546; 252/550; 252/551; 252/DIG. 5; 252/DIG. 13; 252/DIG. 14

[58] Field of Search ..... 252/546, 527, DIG. 5, 252/13, 117

[56] References Cited

U.S. PATENT DOCUMENTS

| | | | |
|---|---|---|---|
| 4,578,216 | 3/1986 | Fujii et al. | 252/542 |
| 4,749,515 | 6/1988 | Miyamoto et al. | 252/545 |
| 4,919,846 | 4/1990 | Nakama et al. | 252/542 |

FOREIGN PATENT DOCUMENTS

| | | |
|---|---|---|
| 0460566 | 12/1991 | European Pat. Off. . |
| 59-179597 | 10/1984 | Japan . |
| 63-30599 | 2/1988 | Japan . |
| 1153796 | 6/1989 | Japan . |
| 1178597 | 7/1989 | Japan . |
| 2226045 | 6/1990 | United Kingdom . |

OTHER PUBLICATIONS

Zussman et al., "Acylated Amino Acids in Shampoos", *Journal of the Society of Cosmetic Chemists*, vol. 6, No. 5, Dec. 1955.

CA 106(8):55616t (JP 61216724, Sep. 1986).

CA 111(20):180454t (JP 1061414, Mar. 1989).

CA 109(8):57101g (JP 63002962, Jan. 1988).

*Primary Examiner*—Paul Lieberman

*Assistant Examiner*—A. Hertzog

*Attorney, Agent, or Firm*—Sughrue, Mion, Zinn, Macpeak & Seas

[57] ABSTRACT

A liquid detergent composition is disclosed, which has a pH value ranging from 6 to 8 and comprises the following Components (A), (B) and (C):

(A) an N-acylamino acid salt represented by formula (1):

$$R^1CONH(CH_2)_nCOOK \quad (1)$$

wherein $R^1CO$ represents a straight-chain acyl group having 10 to 16 carbon atoms, n is a number of 1 or 2 and K is potassium;

(B) a water-soluble anionic surfactant selected from the group consisting of an alkylsulfuric acid salt, a polyoxyethylene alkyl ether sulfuric acid salt, an amidoamino acid salt, an N-acylmethyltaurine salt, a polyoxyethylene alkylsulfosuccinic acid salt, an N-acylmethyl-$\beta$-alanine salt, an N-acylsarcosine salt and an acylglutamic acid salt; and (C) water, wherein a weight ratio of the component (A) to the component (B) is from 6/1 to $\frac{1}{3}$. The liquid detergent of the present invention is hardly irritative to the skin and hair, has high detergency and gives excellent feeling during and after use.

5 Claims, No Drawings

LIQUID DETERGENT COMPOSITION BASED ON N-ACYLAMINO ACID POTASSIUM SALT

FIELD OF THE INVENTION

This invention relates to liquid detergent compositions, more particularly to a liquid detergent composition which is hardly irritative against the skin and hair, has high detergency and gives an excellent feeling during and after washing.

BACKGROUND OF THE INVENTION

Detergent compositions for body use generally contain anionic surfactants, such as an N-alkylacylamino acid-based surfactant, as the main component. For example, JP-A-63-2962 discloses a liquid detergent composition in which an N-alkylacylamino acid-based surfactant is used as a low irritative base material. (The term "JP-A" as used herein means an "unexamined published Japanese patent application".)

However, the N-alkylacylamino acid surfactants contained in the prior art detergents are tertiary amide type N-alkyl-N-acylamino acid salts, and they give an unpleasant feeling when used, such as poor foam breakage, a slimy feel and the like, though they have excellent water solubility.

In addition, JP-A-63-2962 discloses at its Example 5 N-lauroyl-β-alanine sodium salt which is a secondary amide type N-acylamino acid salt. This salt, however, is hardly applicable to a liquid detergent because of its low water solubility. Also, JP-A-63-2962 further discloses to employ the compound at a concentration of 1%, but the compound could not give an excellent feeling upon use even when it was employed in such concentration.

In consequence, great concern has been directed toward the development of a liquid detergent composition which is hardly irritative against the skin and hair, has high detergency and gives an excellent feeling upon use.

On the other hand, the present inventors have found as a result of intensive investigation that an N-acylated amino acid salt which is used in the present invention as component (A) can provide a hardly irritative detergent composition having high detergency and excellent feeling upon use. However, when such an N-acylated amino acid salt is employed in a liquid detergent having a pH value ranging from 6 to 8, it gives precipitation of crystals of an N-acrylated amino acid, which is an unneutralized compound of the N-acrylated amino acid salt, so that a stable liquid detergent composition has hardly been obtained with the use of the N-acrylated amino acid salt.

SUMMARY OF THE INVENTION

The present inventors have continued intensive studies and, as a result, they found that the detergent composition can be stably dispersed or solubilized by blending the composition further with an anionic surfactant having high water solubility, thereby accomplishing the present invention.

Accordingly, an object of the present invention is to provide a liquid detergent composition having a pH value ranging from 6 to 8 and comprising the following components (A), (B) and (C):

(A) an N-acylamino acid salt represented by formula (1):

$$R^1CONH(CH_2)_nCOOK \quad (1)$$

wherein $R^1CO$ represents a straight-chain acyl group having 10 to 16 carbon atoms, n is a number from 1 to 2 and K is potassium;

(B) a water-soluble anionic surfactant selected from the group consisting of an alkylsulfuric acid salt, a polyoxyethylene alkyl ether sulfuric acid salt, an amidoamino acid salt, an N-acylmethyltaurine salt, a polyoxyethylene alkylsulfosuccinic acid salt, an N-acylmethyl-β-alanine salt, an N-acylsarcosine salt and an acylglutamic acid salt; and (C) water, wherein a weight ratio of the component (A) to the component (B) is from 6/1 to ⅓.

Other objects and advantages of the present invention will be made apparent as the description progresses.

DETAILED DESCRIPTION OF THE INVENTION

The gist of the present invention resides in a liquid detergent composition which has a pH value ranging from 6 to 8 and comprises the following components (A), (B) and (C):

(A) an N-acylamino acid salt represented by formula (1):

$$R^1CONH(CH_2)_nCOOK \quad (1)$$

wherein $R^1CO$ represents a straight-chain acyl group having 10 to 16 carbon atoms, n is a number of 1 or 2 and K is potassium;

(B) a water-soluble anionic surfactant selected from the group consisting of an alkylsulfuric acid salt, a polyoxyethylene alkyl ether sulfuric acid salt, an amidoamino acid salt, an N-acylmethyltaurine salt, a polyoxyethylene alkylsulfosuccinic acid salt, an N-acylmethyl-β-alanine salt, an N-acylsarcosine salt and an acylglutamic acid salt; and (C) water, wherein a weight ratio of the component (A) to the component (B) is from 6/1 to ⅓.

With regard to the N-acylamino acid potassium salt as the component (A) represented by formula (1), the $R^1CO$ group in the formula may be selected preferably from straight-chain acyl groups each having 12 to 14 carbon atoms (e.g., lauroyl group, myristoyl group), of which a lauroyl group having 12 carbon atoms is particularly preferred. If the number of carbon atoms is larger than 16, the lubricating ability of plate crystals formed during use and foaming ability may be reduced, and if it is smaller than 10, on the other hand, the foaming ability is reduced. It is strictly important that the N-acyl group has a secondary amide structure composed of the aforementioned straight-chain acyl group. That is, when the acyl group has branched chains or the amide structure is a tertiary amide type, the effect of the present invention cannot be obtained because of poor lubricating ability and too much stickiness of the resulting product. In the above formula (1), n is a number of 1 or 2 but preferably is 2. It is also important that the salt of the component (A) is potassium. When the component is the sodium salt, its Krafft point becomes high and its water solubility becomes poor, thus entailing a difficulty in applying it to a liquid detergent.

The component (A) of the present invention may be contained in the composition in an amount ranging from 3 to 20% by weight, preferably from 5 to 15% by weight, based on the total weight of the composition. If the amount is smaller than 3% by weight, the plain and good feel upon use due to plate crystals formed during rinsing may be deteriorated, whereas if it is larger than 20% by weight, a difficulty is caused in the production of the liquid detergent composition because of gelation of the liquid.

The water-soluble anionic surfactant as the component (B) is selected from the group consisting of an alkylsulfuric acid salt, a polyoxyethylene alkyl ether sulfuric acid salt, a secondary or tertiary amidoamino acid salt which is a so-called "imidazoline type surfactant" (as disclosed in JP-A-63-128100) (for example, sodium 2-alkyl-N-carboxymethyl-N-hydroxyethylimidazolinium betaines), an N-acyl-methyltaurine salt, a polyoxyethylene alkylsulfosuccinic acid salt, an N-acyl-methyl-$\beta$-alanine salt, an N-acyl-sarcosine salt and an acylglutamic acid salt. The number of the carbon atoms in the alkyl or acyl group of these surfactants ranges from 8 to 20, preferably from 12 to 18. Further, the Krafft point of these surfactants is preferably 0° C. or below. These surfactants may be used either alone or as a mixture of two or more thereof. Salts of these surfactants include, for example, alkali metal salts such as of sodium, potassium and the like; organic amine salts such as of triethanolamine, basic amino acids and the like; and an ammonium salt. Of these surfactants as the component (B), polyoxyethylene alkyl ether salts and amidoamino acid salts are preferred, and amidoamino acid salts are more preferred.

The component (B) may be contained in the total composition in an amount ranging from 2 to 20% by weight, preferably from 3 to 10% by weight. The liquid detergent composition of the present invention may contain the components (A) and (B) in a total amount ranging from 5 to 40% by weight, preferably from 8 to 30% by weight.

In addition, the components (A) and (B) may be used at a weight ratio of the component (A) to the component (B) of from 6/1 to $\frac{1}{3}$, preferably from 3/1 to $\frac{1}{3}$. If the component (B) is contained at a larger ratio than this range, the feel upon use may be deteriorated due to decrease in the lubricating ability, and if it is smaller than this range, on the other hand, a difficulty is caused in stably dispersing or solubilizing the component when formulated into a liquid.

The pH value of the liquid detergent composition of the present invention is adjusted to the range of from 6 to 8, preferably from 7 to 8.

The pH value of the liquid detergent composition can be adjusted in a conventional manner. For example, it can be adjusted by adding to the composition an appropriate amount of an acidic substance such as succinic acid, citric acid, phosphoric acid and the like; or an alkaline substance such as potassium hydroxide and the like, in accordance with the original pH value of the composition itself.

As a matter of course, there is no need to further adjust the pH value of the composition when the pH value of the composition originally falls with in the range according to the present invention.

In addition to the aforementioned characteristic properties, a detergent further having excellent foaming ability and a good feel of foam can be obtained by blending the detergent composition of the present invention with a higher fatty acid salt as the component (D). The higher fatty acid salt (D) may be selected for example from basic salts of fatty acids having 8 to 22 carbon atoms. Illustrative examples thereof include basic salts of a single fatty acid such as lauric acid, myristic acid, palmitic acid, isostearic acid, oleic acid or the like, as well as basic salts of a mixed fatty acid such as coconut oil fatty acid, tallow fatty acid or the like. Useful salts include, for example, inorganic basic salts such as of sodium, potassium and the like; an ammonium salt, monoethanolamine salt, diethanolamine salt, triethanolamine salt (to be referred to as "TEA" hereinafter); alkanolamine salts such as of 2-amino-2-methylpropanol, 2-amino-2-methylpropanediol and the like; and basic amino acids such as lysine, arginine and the like. It is not always necessary to blend the higher fatty acid salt (D) in the form of salt, that is, the respective fatty acid and base may be blended separately to form the corresponding fatty acid salt in the formulation system. These higher fatty acid salts may be used either alone or as a mixture of two or more thereof. Amounts of the higher fatty acid salt (D) to be contained in the detergent composition of the present invention may vary depending on the blending ratio of the components (A) and (B), but preferably are in a weight ratio of (D)/(A)+(B) of from 1/20 to $\frac{1}{2}$, more preferably from 1/10 to $\frac{1}{3}$.

The detergent composition of the present invention may optionally contain, within a range which does not spoil the effect of the present invention, other surfactants which include, for example, anionic surfactants such as an alkyl ether acetic acid salt surfactant, a polyoxyethylene alkyl ether acetic acid salt surfactant and the like; nonionic surfactants such as a fatty acid amide surfactant, a polyoxyethylene alkyl ether surfactant, a sugar ester-based surfactant, a sugar ether-based surfactant, a sugar amide-based surfactant and the like; and ampholytic surfactants such as an imidazoline-type surfactant, a betaine-type surfactant and the like; of which a betaine-type surfactant is particularly preferred since its joint use further improves foaming ability and stability of the detergent composition of the present invention.

If necessary, the liquid detergent composition of the present invention may be made into a paste or gel form by mixing it with a thickener, a coagulating agent and the like.

Duration of germicidal effect and plain usage feeling of the liquid detergent of the present invention may be further improved by the addition of germicides such as triclosan, trichlorocarbanilide, isopropylmethylphenol, chlorhexydine hydrochloride and the like, of which triclosan and trichlorocarbanilide are particularly preferred.

The liquid detergent of the present invention may also be blended with other components which are conventionally used in detergent compositions, such as moisture retaining agents, feeling improving agents, viscosity controlling agents, perfumes, pigments and the like, provided that they are used in such amounts that they do not inhibit formation of plate crystals which show excellent lubricating ability at the time of rinsing.

The liquid detergent composition of the present invention may be prepared in a conventional manner.

The liquid detergent composition of the present invention which has been described in the foregoing in detail can be applied suitably to detergents for body use, such as a skin wash and a hair wash, especially to a skin wash.

The following examples are provided to further illustrate the present invention. It is to be understood, however, that the examples are for purpose of illustration only and are not intended as a definition of the limits of the invention.

EXAMPLE 1

Liquid detergent compositions of formulations shown in Table 1 below were prepared in a conventional manner and their performances on stability and foaming ability were examined in the following manner.

Stability

Each liquid detergent composition was stored at 25° C. for 1 month and then its appearance was observed with naked eye and evaluated in accordance with the following criteria.

A: The detergent remained a transparent liquid.

B: The detergent separated, showed precipitation of crystals, or turned into a gel.

Foaming ability

Each liquid detergent composition was stored at 5° C. for 1 month and then diluted tenfold with water. One hundred milliliter of the resulting solution (at 40° C.) was poured into a measuring cylinder and a stirring impeller was placed thereinto. Then agitation was proceeded at 1,000 rpm while reversing the rotation at every 5 seconds. At 30 seconds after the beginning of the agitation, the volume (ml) of foam formed on the surface of the detergent solution was measured and evaluated in accordance with the following criteria.

A: more than 200 ml

B: 200 to 150 ml

C: less than 150 ml to 100 ml

D: less than 100 ml

The results are shown in Table 1 below.

TABLE 1

| Component | Product of the Invention 1 | 2 | 3 | 4 | 5 | Comparative Product 6 | 7 | 8 |
|---|---|---|---|---|---|---|---|---|
| Potassium lauroyl-β-alanine | 6 | 6 | 6 | 6 | 8 | 6 | 6 | — |
| Sodium lauroyl-β-alanine | — | — | — | — | — | — | — | 6 |
| Sodium Polyoxyethylene (3) lauryl ether sulfate | 5 | — | — | — | — | — | — | — |
| Sodium coconut oil fatty acid methyltaurine | — | 5 | — | — | — | — | — | — |
| Sodium 2-alkyl-N-carboxymethyl-N-hydroxyethylimidazolinium betaine | — | — | 5 | 5 | 7 | — | — | 5 |
| Potassium laurate | — | — | — | 2 | 2 | — | 2 | 2 |
| Purified water | balance | balance | balance | balance | balance | balance | balance | balance |
| pH value | 7.8 | 7.9 | 7.7 | 7.8 | 7.8 | 7.7 | 7.8 | 7.8 |
| Evaluation: | | | | | | | | |
| Stability | A | A | A | A | A | B | B | B |
| Foam ability | B | B | B | A | A | D | C | C |

EXAMPLE 2

A detergent composition of the following formulation was prepared.

Formulation

| Component | Amount (% by weight) |
|---|---|
| (1) Potassium lauroyl-β-alanine | 7 |
| (2) Sodium 2-alkyl-N-carboxymethyl-N-hydroxyethylimidazolinium betaine | 5 |
| (3) Lauric | 2 |
| (4) Lauroylamidopropyldimethylcarboxy betaine | 3 |
| (5) Potassium hydroxide | appropriate amount |
| (6) Perfume | 0.5 |
| (7) Dimethylhydroxytoluene | 0.2 |
| (8) Ethanol | 3 |
| (9) Purified water | balance |

Production method

The components (1) to (4) and hot water (the component (9)) were mixed and the pH value of the resulting mixture was adjusted to 7.8 with potassium hydroxide. After cooling the mixture, the components (6) to (8) were added thereto to give a transparent liquid detergent composition.

The liquid detergent composition thus obtained had a good stability and, when the body was washed with it, it gave a good foam ability, showed a good foam breakage, and gave a good slipperiness through rinsing to after dried, thus totally it had excellent feel upon use.

While the invention has been described in detail with reference to specific embodiments thereof, it will be apparent to one skilled in the art that various changes and modifications can be made therein without departing from the spirit and scope thereof.

What is claimed is:

1. A liquid detergent composition having a pH value ranging from 6 to 8 and consisting essentially of the following components (A), (B) and (C):

(A) an N-acylamino acid salt represented by formula (1):

$$R^1CONH(CH_2)_nCOOK \quad (1)$$

wherein $R^1CO$ represents a straight-chain acyl group having 10 to 16 carbon atoms, n is a number of 1 or 2 and K is potassium;

(B) a water soluble anionic surfactant selected from the group consisting of an alkylsulfuric acid salt, a polyoxyethylene alkyl ether sulfuric acid salt, an amidoamino acid salt, an N-acylmethyltaurine salt, a polyoxyethylene alkysulfosuccinic acid salt, an N-acylmethyl-β-alanine salt, an N-acylsarcosine salt and an acylglutamic acid salt; and (C) water, wherein a weight ratio of said Component (A) to said Component (B) is from 3/1 to ⅓ and wherein said component (A) is contained in an amount ranging from 3 to 20% by weight and said component (B) is contained in an amount ranging from 2 to 20% by weight.

2. A liquid detergent composition of claim 1, wherein said component (B) is a polyoxyethylene alkyl ether sulfuric acid salt or an amidoamino acid salt.

3. A liquid detergent composition of claim 1, wherein said $R^1CO$ in formula (1) is a lauroyl group or a myristoyl group.

4. A liquid detergent composition of claim 1, wherein said symbol n in formula (1) is 2.

5. A liquid detergent composition of claim 1, wherein the following component (D) is further contained:

(D) a higher fatty acid salt, wherein the weight ratio of (D)/(A)+(B) is from 1/20 to ½.

* * * * *